US006079711A

United States Patent [19]

Wei et al.

[11] Patent Number: 6,079,711

[45] Date of Patent: Jun. 27, 2000

[54] COMBINATION BINGO AND POKER GAME

[75] Inventors: William Wei, Williamston; Jeffery A. Dettloff, Lansing; Ronald J. Austin, Lansing; Richard G. Bean, Lansing; Harrold J. Rappold, Laingsburg; James L. Green, Grand Ledge, all of Mich.

[73] Assignee: Melange Computer Services, Inc., Lansing, Mich.

[21] Appl. No.: 09/116,358

[22] Filed: Jul. 16, 1998

[51] Int. Cl.[7] ..... A63F 1/00

[52] U.S. Cl. ..... 273/269; 273/274; 273/292

[58] Field of Search ..... 273/274, 292, 273/269, 270, 264, 271

[56] References Cited

U.S. PATENT DOCUMENTS

| | | |
|---|---|---|
| Re. 34,673 | 7/1994 | Desbiens . |
| 1,723,377 | 8/1929 | Salomon . |
| 2,355,785 | 8/1944 | Dorfman . |
| 4,021,937 | 5/1977 | Kravitz . |
| 4,364,567 | 12/1982 | Goott . |
| 4,441,714 | 4/1984 | Goott . |
| 4,560,171 | 12/1985 | Anthony . |
| 5,100,139 | 3/1992 | Di Bella . |
| 5,393,057 | 2/1995 | Marnell, II . |
| 5,816,577 | 10/1998 | Preston et al. . |
| 5,882,260 | 3/1999 | Marks et al. . |

FOREIGN PATENT DOCUMENTS

| | | |
|---|---|---|
| 1172231 | 11/1969 | United Kingdom . |

*Primary Examiner*—William M. Pierce
*Attorney, Agent, or Firm*—Mary M. Moyne; Ian C. McLeod

[57] ABSTRACT

A combination Bingo and Poker game is described. The game uses a game board (10) containing a matrix of Bingo places (16). The Bingo places each have a Bingo number (26) and playing card indicia (28). The game is played similarly to standard Bingo with the players marking the places on the game board as the numbers are selected by the host entity (12A). A player has a winning BINGO when the marked places form a winning Bingo configuration. The playing card indicia of the places of the winning Bingo configuration are then used to form a potentially winning Poker hand.

12 Claims, 4 Drawing Sheets

COMBINATION BINGO AND POKER GAME

BACKGROUND OF THE INVENTION

1. Field of the Invention

The present invention relates to a combination Bingo and Poker game. In particular, the present invention relates to a combination Bingo and Poker game which is played similarly to traditional Bingo games with the winning Bingo places on the game boards or sheets having playing card indicia associated with them. The playing card indicia are used to form a Poker hand. The game allows the winner of a BINGO to potentially win a second time by forming a Poker hand with the card indicia revealed by the winning BINGO configuration.

2. Description of Related Art

Applicant had previously created a Bingo game where the places on the game board contained playing card indicia as well as Bingo numbers. A game board for that game is similar to the WIN-RIVER CASINO game board as shown in FIG. 1. In this previous game, each row on the game board contained playing card indicia for only the five (5) highest cards for each suit. Therefore, each row on the board represented a winning Poker hand corresponding to a straight flush for each of the four suits. Since the standard Bingo game board contains five (5) rows, the middle row of the game board contained jokers. In this game, there was no need for the winner to calculate the Poker hand. The Poker hand would always be a straight flush if the winner has a straight row BINGO. This Bingo game did not include random placement of the playing card indicia on the game board. The game also did not use the entire deck, but rather only the five (5) highest cards for each suit.

U.S. Pat. No. 5,393,057 to Marnell, II describes an electronic Poker game which is electronically connected to a Bingo game. The Bingo matrix has indicia representing randomly selected winning Poker hands. Upon occurrence of selected Poker hands in the Poker game, the results are automatically entered into the matrix of the Bingo game. The primary game being played is Poker with a secondary game of Bingo being played simultaneously. This game is not played similarly to Bingo, the primary game is Poker with the players playing numerous games of Poker before being able to achieve a BINGO.

The other related art has shown various types of Bingo games having added features. Illustrative are U.S. Pat. Nos. 4,021,936 to Kravitz, and Re. 34,673 to Desbiens.

Kravitz describes a language teaching game played similar to Bingo. The locations on the Bingo card are represented by words or phrases. Upon achieving BINGO, the player receives extra points by constructing sentences from the words and phrases under the winning Bingo configuration.

Desbiens describes a two level Bingo game. The first level is played similarly to traditional Bingo. Once a BINGO is obtained, the player scratches off the winning Bingo locations to determine whether an instant prize was also won.

The other related art has also shown various types of poker games having added features. Illustrative are U.S. Pat. Nos. 1,723,377 to Salomon, 2,355,785 to Dorfman, 4,364,567 and 4,441,714 to Goott, and 4,560,171 to Anthony.

Dorfman shows a Poker game which uses game boards having playing card indicia. Additional cards are dealt from the deck to be associated with the playing card indicia on the game boards. The game can be played similarly to a standard Poker game. The game can also be played similar to a horse race where the player, having the highest Poker hand when all of the cards have been dealt, is considered the winner of the race.

Salomon describes a Poker game where each player has a game board having a different arrangement of cards therein. A dealer selects cards from a deck of fifty-two (52) cards. As the dealer selects the cards, the player marks the matching card on his game board. A winner can be determined by whichever player has all of the cards of a winning hand. Alternatively, a winner can be determined when a player covers a complete row or column on his game board.

U.S. Pat. Nos. 4,364,567 and 4,441,714 to Goott describe combination Poker-Keno-type games.

Anthony describes a Poker game which has a playing board having places containing the fifty-two (52) cards of a Poker deck. The places also contain a number which is not associated with the playing cards. To play, numbers are chosen corresponding to the numbers on the playing board. The player's Poker hand is based on the cards associated with the places on the board having the chosen numbers.

There remains the need for a combination Bingo and Poker game which is played similarly to standard Bingo and which has playing card indicia on the places of the winning BINGO which are used to form a Poker hand.

Objects

It is therefore an object of the present invention to provide a combination Bingo and Poker game which is played similarly to Bingo. Further, it is an object of the present invention to provide a combination Bingo and Poker game which can be played by a plurality of players at one time. Still further, it is an object of the present invention to provide a combination Bingo and Poker game where the places on the game board are provided with randomly selected Bingo numbers and randomly selected playing card indicia. Further still, it is an object of the present invention to provide a combination Bingo and Poker game where the playing card indicia of the winning Bingo places are used to form a Poker hand, which may be a winning Poker hand. Further, it is an object of the present invention to provide a method of playing a combination Bingo and Poker game where the game board places are provided with Bingo numbers and playing card indicia and Bingo numbers are randomly selected which correspond to the Bingo numbers on the game board and where the game card indicia of places corresponding to a winning Bingo configuration are used to form a Poker hand. These and other objects will become increasingly apparent by reference to the following drawing and the description.

DETAILED DESCRIPTION OF THE PREFERRED EMBODIMENTS

The present invention relates to a combination Bingo and Poker game, which comprises, a plurality of game boards each game board having a plurality of places at least one of the places having a Bingo number and a randomly selected playing card indicia and means for randomly selecting winning Bingo numbers corresponding to some of the bingo numbers on the plurality of game boards wherein a game board has a winning Bingo when at least some of the places having the Bingo numbers corresponding to the winning Bingo numbers have a predetermined Bingo configuration and wherein a game board with a winning Bingo has a winning Poker hand when the playing card indicia of at least some of the places in the predetermined Bingo configuration form a predetermined winning Poker hand.

Further, the present invention relates to a method of playing a combination Bingo and Poker game, which comprises the steps of providing a plurality of game boards each game board having a plurality of places at least one of the places having a Bingo number and a playing card indicia; randomly selecting winning Bingo numbers which correspond to Bingo numbers on the game boards; marking the places on each of the game boards having the Bingo numbers corresponding to the winning Bingo numbers until some of the marked places have a predetermined winning Bingo configuration; and forming a Poker hand from the playing card indicia of the marked places forming the predetermined winning Bingo configuration.

Figure 1:
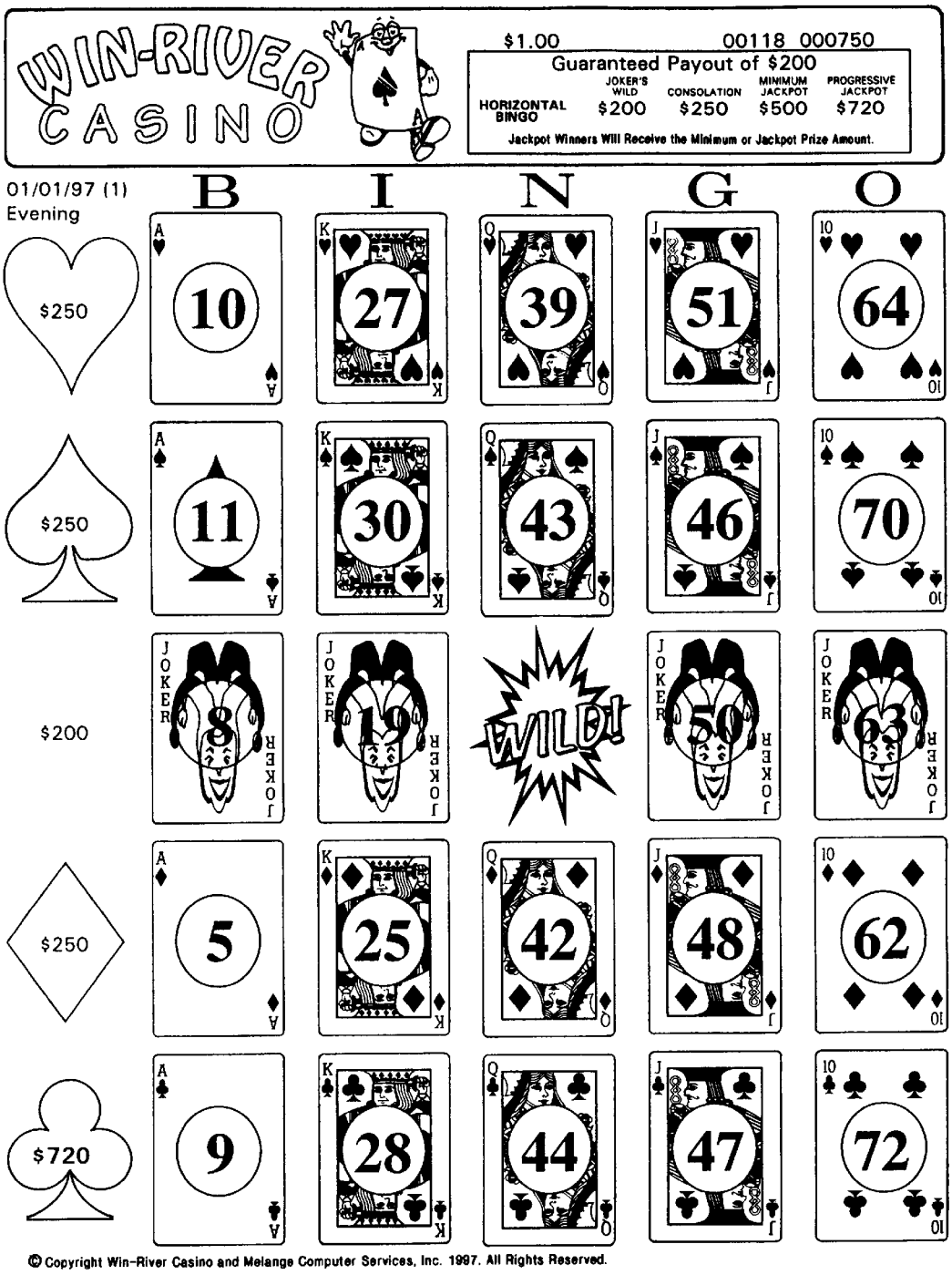
FIG. 1 (PRIOR ART)
FIG. 1 is a prior art game board with each row having a winning Poker hand corresponding to a straight flush.
Figure 2:
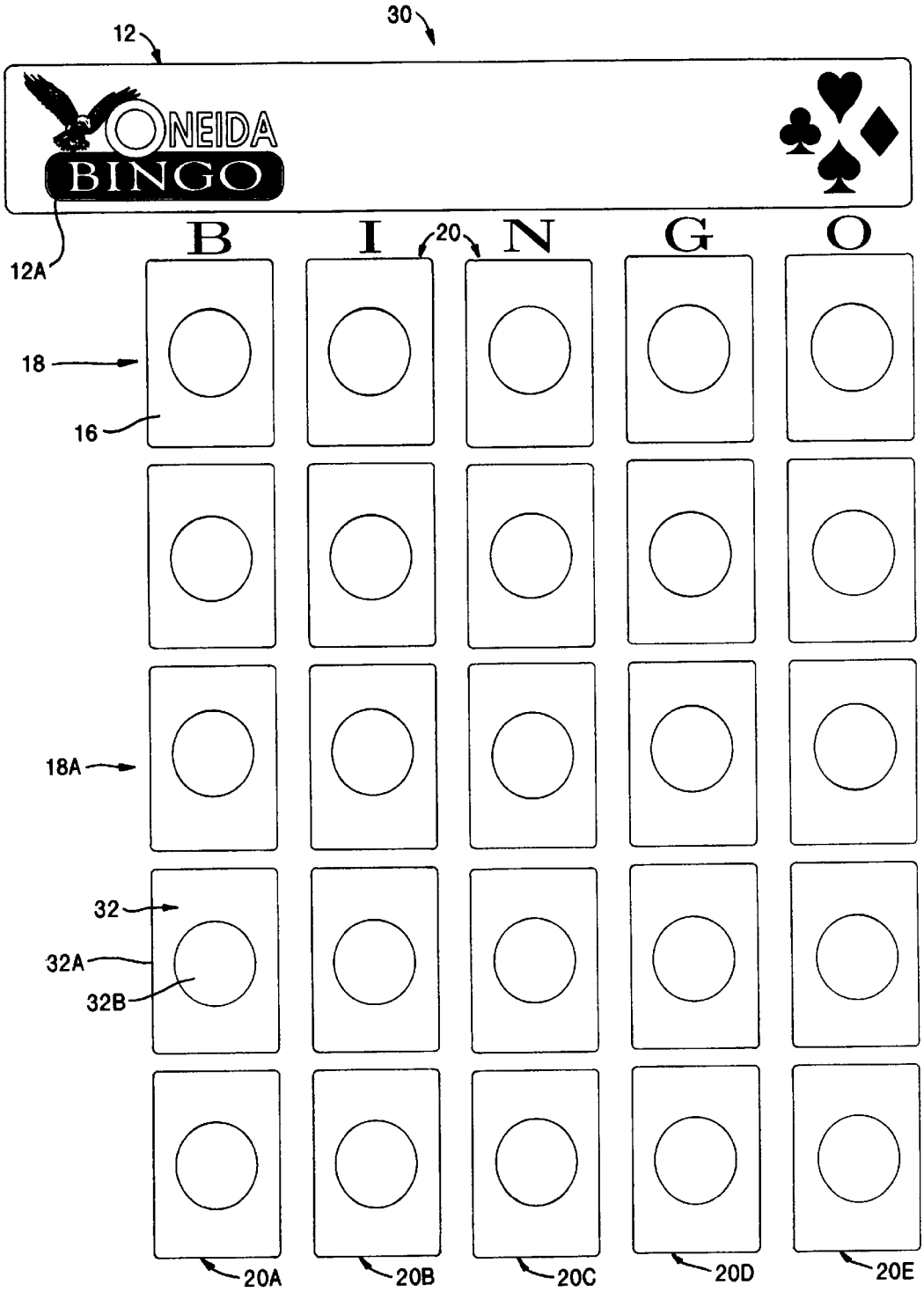
FIG. 2 is a blank game board stock 30 showing the top identification section 12 and the places outline 32.
Figure 3:
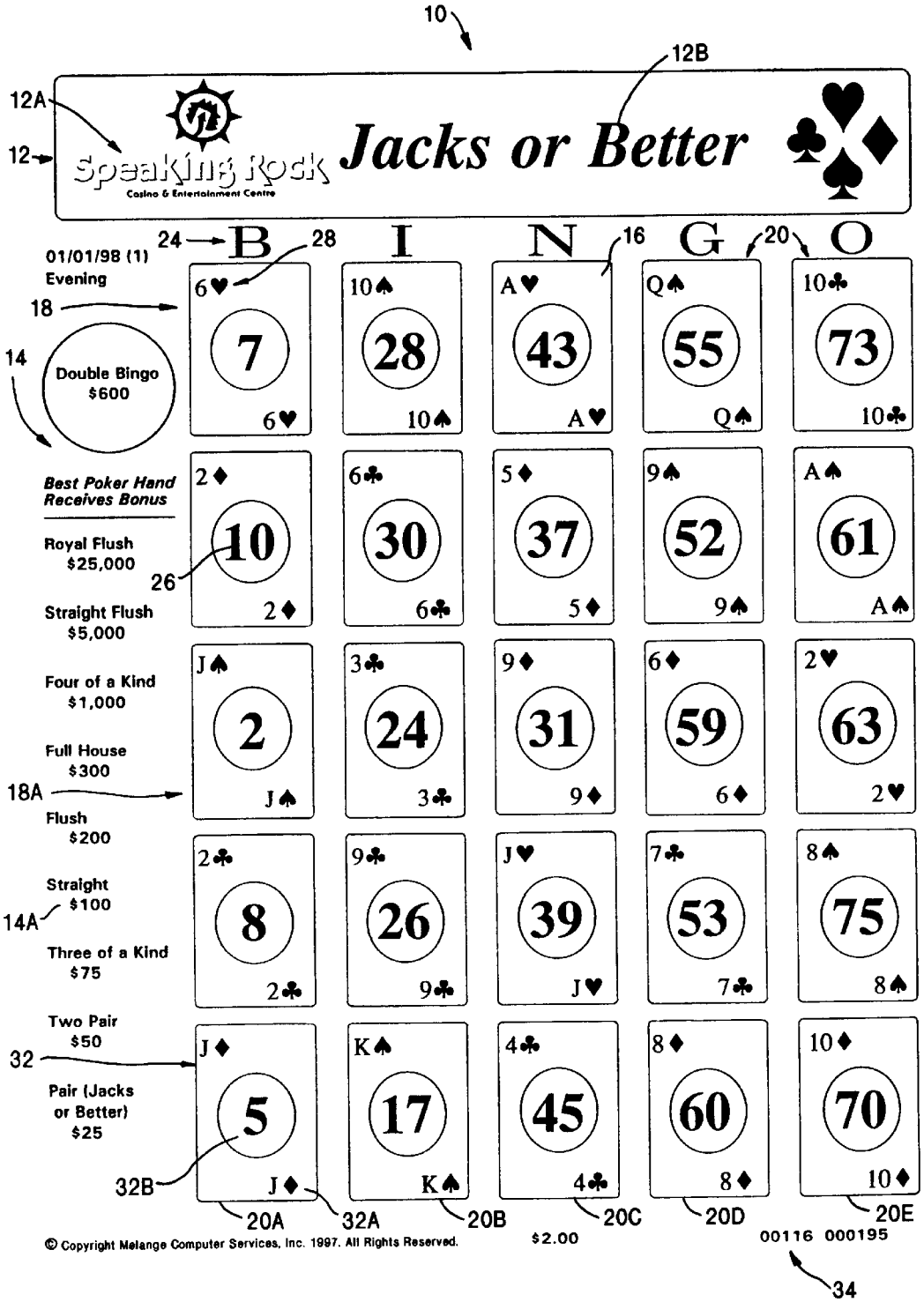
FIG. 3 is a schematic view of a game board 10 showing the Bingo numbers 26 and the playing card indicia 28.
Figure 4:
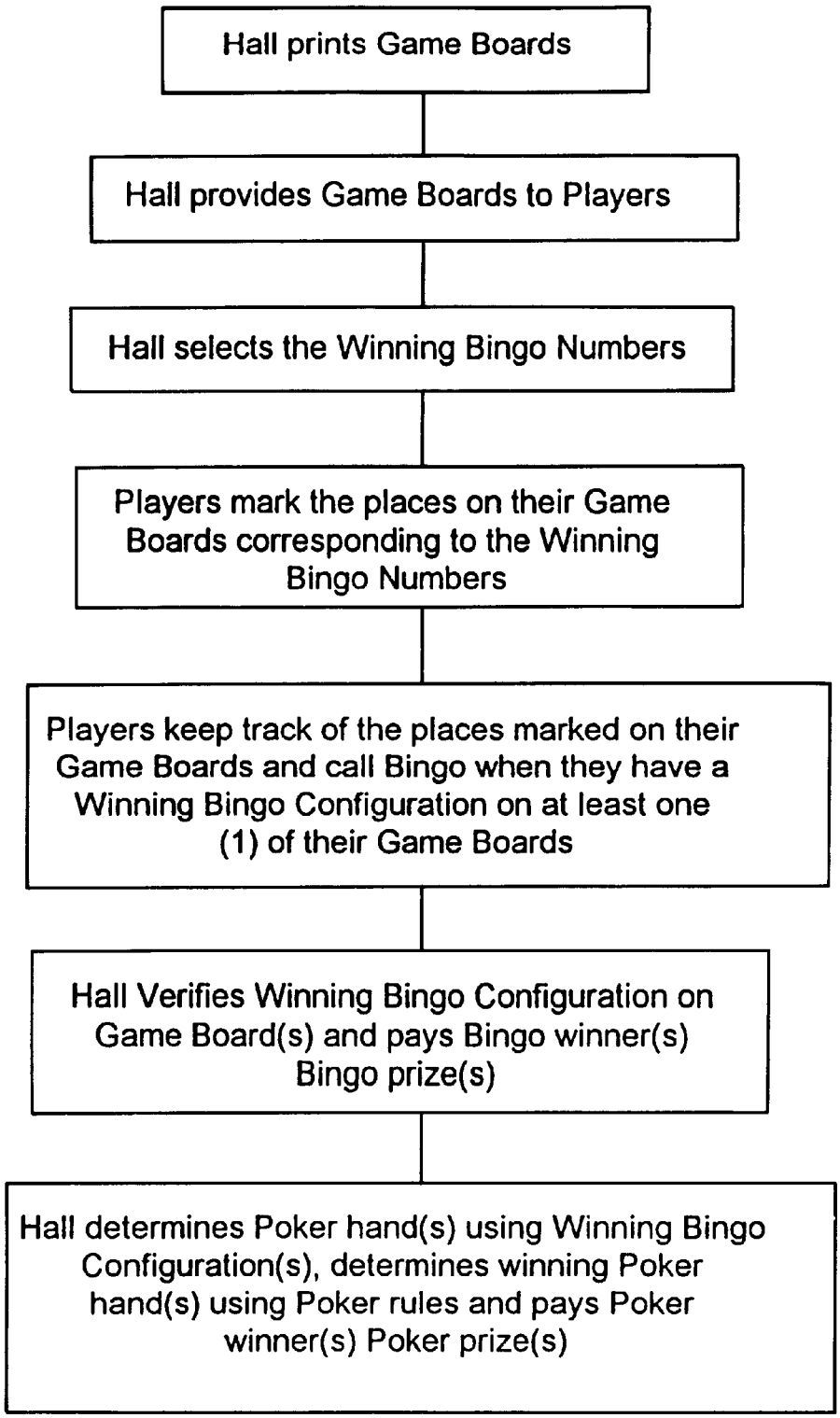
FIG. 4 is a flowchart showing the method of playing the combination Bingo and Poker game.

The present invention relates to a combination Bingo and Poker game which uses game boards or sheets 10 having both Bingo numbers 26 and playing card indicia 28. FIG. 3 shows one game board 10 which is used with the combination Bingo and Poker game of the present invention. The face 10A of the game board 10 is preferably similar to standard Bingo game boards 10 and include a top identification section 12, a side prize defining section 14 and a matrix of Bingo places or locations 16. The top identification section 12 preferably identifies the entity 12A that is hosting the game, as well as the specific version or name 12B of the game which is to be played. The entity 12A hosting the game is preferably preprinted in the top identification section 12 of the card stock 30 prior to printing the Bingo numbers 26 and playing card indicia 28 on the face 10A of the game board 10 (FIG. 2). The prize defining section 14 of the game board 10 preferably extends along one of the sides of the game board 10 on the face 10A of the game board 10. In the preferred embodiment, the prize defining section 14 extends along the side of the game board 10 adjacent the B Column 20A of the game board 10. The prizes 14A are preferably provided for both a winning BINGO and a winning Poker hand. The prizes 14A are determined by the host entity 12A. Preferably, the computer program used to print the game boards 10 and to determine the winner is also used to track prizes 14A (to be discussed in detail hereinafter).

In the preferred embodiment, the matrix of Bingo places 16 on each game board 10 contains five (5) rows 18 and five (5) columns 20 for a total of twenty-five (25) places 16. The top of each column 20 has a Bingo column identifier 24 which is preferably a letter. The Bingo column identifiers 24 when read from left to right, form the word BINGO. Similar to standard Bingo game boards 10 each of the twenty-five (25) places 16 on the board is provided with a Bingo number 26. Preferably each column 20 has a range of fifteen (15) numbers. Preferably the B column 20A contains five (5) Bingo numbers 26 ranging from and including 1–15. The I column 20B preferably has five (5) Bingo numbers 26 ranging from and including 16–30. The N column 20C has five (5) Bingo numbers 26 ranging from and including 31–45. The G column 20D has five (5) Bingo numbers 26 ranging from and including 46–60. Finally, the O column 20E has five (5) Bingo numbers 26 ranging from and including 61–75. Therefore, the game board 10 contains twenty-five (25) numbers ranging from and including 1–75. However, other than the above limitations, the Bingo numbers 26 for the places 16 are randomly selected. The places 16 on the game board 10 also contain playing card indicia 28. In the preferred embodiment, the playing card indicia 28 are selected from a full standard Poker deck of fifty-two (52) cards. In an alternate embodiment (not shown), jokers are also used in the playing card indicia 28. In the alternate embodiment the jokers are preferably located in the center row 18A or the center place 16A of the game board 10. In another alternate embodiment (not shown) the center place 16A on the game board 10 is a wild place or free place and can always be used to form the winning Bingo configuration. The playing card indicia 28 for each place 16 is preferably randomly selected.

In the preferred embodiment, specific Bingo numbers 26 and playing card indicia 28 for the places 16 on the game board 10 are determined by a computer program. The computer program generates the Bingo numbers 26 and playing card indicia 28 and prints the combinations on preprinted Bingo game board stock 30 (FIG. 2). The preprinted game board stock 30 preferably includes the top identification section 12, the BINGO column identifiers 24 and a places outline 32. The game board stock 30 is preprinted and delivered in quantity to the hosting entity 12A. The game board stock 30 is preferably constructed of standard paper, such that a standard laser or ink jet printer may be used to print the game boards 10. The blank game board stock 30 can be used for a variety of different types of combination Bingo and Poker games. The places outlines 32 preferably have an outer card outline 32A having a rectangular shape, similar to a standard playing card. The places outline 32 also has a Bingo number section 32B. In the preferred embodiment, the Bingo number section 32B is a circle positioned in the center of the outer card outline 32A. The prizes 14A, the playing card indicia 28 and the Bingo numbers 26 are preferably printed on the game board stock 30 just prior to the game being sold. By printing the final game board 10 just prior to the game, the user is able to maintain security over the final printed game boards 10. In addition, the prizes 14A printed on the game boards 10 can be recalculated based on the requirements of the host entity 12A in the previous game.

The game boards 10 are printed at the host site daily using the computer program. The entity 12A determines the number of game boards 10 to be printed. The playing card indicia 28, located on the places 16 of the game board 10, are randomly generated using the computer program. The game boards 10 are generated from cycling through a series of 10,000 random and unique Bingo permutations. Preferably, the computer program ensures that duplicate game boards 10 are not produced for the same game. The computer program also preferably allows for easier, quicker verification of winning game boards 10. In addition to the playing card indicia 28 and Bingo numbers 26, a verification or identification number 34 is also printed on the face 10A of the game board 10. The identification number 34 allows the computer program to be used to quickly and easily verify a winning BINGO or Poker hand.

To play the game, the entity 12A uses standard Bingo equipment (not shown) to call the Bingo numbers 26. Standard Bingo equipment includes, a blower, a set of Bingo balls numbered 1–75 and a flashboard. The combination Bingo and Poker game preferably operates on standard computer equipment (not shown). However, the Bingo and Poker game can also be played and the winners determined manually. This equipment consists of a network or standalone computer, a laser printer and a video output device to interface with the television monitor verification system. The game can also be configured to operate on a NOV- ELL™ network or other PC based computer equipment which may already be installed at the host site. As the Bingo numbers 26 are called by a caller, the entity 12A enters the numbers into the computer and the players mark their game boards 10 accordingly. A player calls "BINGO" once the marked places 16 on the game board 10 correspond to a winning Bingo configuration. All valid BINGOs must be on the "last number called". Players notifying the host entity 12A of a BINGO will have their game boards 10 verified by having the verification number 34 on the game board 10 recited to the entity 12A, who enters it into the computer. To verify a win, the verification number 34 on the game board 10 is entered into a computer system being used by the entity 12A. The computer will notify the entity 12A whether the BINGO was a valid BINGO or not. As an option, the entity 12A may display the winning game board 10 on monitors such that all players can see the winning game board 10. The computer system will verify multiple BINGO's. When a player obtains a winning Bingo configuration, they win the posted prize 14A once the BINGO has been verified. Once all BINGO's are verified, the computer program identifies the highest winning Poker hand based on the playing card indicia 28 associated with the winning BINGOs. The playing card indicia 28 associated with the places 16 in the valid Bingo configuration are used to form a single five (5) card Poker hand from the playing card indicia 28 available. Consequently, if the Bingo game required a two (2) straight line Bingo configuration to win the Bingo, the player is able to choose the best five (5) card Poker hand from the playing card indicia 28 available. In the preferred embodiment, only the highest poker hand will win an additional bonus "Poker" prize 14A, as printed. Preferably, a consolation prize is split among all valid Bingo pattern winners. The game is then closed when all the winners have been verified.

It is intended that the foregoing description be only illustrative of the present invention and that the present invention be limited only by the hereinafter appended claims.

I claim:

1. A combination Bingo and Poker game, which comprises:

(a) a plurality of game boards for use simultaneously in the game each game board having a plurality of first places, the first places having a Bingo number and a randomly selected playing card indicia wherein the Bingo number and randomly selected playing card indicia in the plurality of first places of at least one of the game boards is different from the Bingo number and randomly selected playing card indicia in the plurality of first places of at least one other game board; and (b) means for randomly selecting winning Bingo numbers corresponding to some of the Bingo numbers on the plurality of game boards wherein a game board has a winning Bingo when at least some of the first places having the Bingo numbers corresponding to the winning Bingo numbers have a predetermined Bingo configuration and wherein a game board with a winning Bingo has a winning Poker hand when the playing card indicia of at least some of the first places in the predetermined Bingo configuration form a predetermined winning Poker hand.

2. The game of claim 1 wherein the first places are arranged in intersecting rows and columns on the game board.

3. The game of claim 2 wherein there are five columns on the game boards, wherein a heading on the columns is a word having letters which spell BINGO from left to right wherein the winning Bingo numbers includes a letter corresponding to one of the letters of the word BINGO and the Bingo number and wherein the letters of the winning Bingo numbers determine which column on the game board the first place having the winning Bingo number is located.

4. The game of claim 2 wherein there are five columns and five rows for a total of 25 places.

5. The game of claim 1 wherein each of the game boards has at least one second place having no Bingo number or playing card indicia which can be used in combination with the first places to form the predetermined Bingo configuration.

6. The game of claim 2 wherein the playing card indicia on each column of first places has a different card suit.

7. The game of claim 1 wherein the Bingo numbers are superimposed over a center of the playing card indicia on the first places on the game boards.

8. The game of claim 1 wherein the Bingo numbers for the first places of the game boards are randomly selected.

9. The game of claim 8 wherein the Bingo numbers and playing card indicia for the first places of the game boards are selected using a computer program.

10. The game of claim 1 wherein the playing card indicia includes jokers.

11. A method of playing a combination Bingo and Poker game, which comprises the steps of:

(a) providing a plurality of game boards for use simultaneously in the game each game board having a plurality of places, the places having a Bingo number and a randomly selected playing card indicia wherein the Bingo number and randomly selected playing card indicia in the plurality of places of at least one of the game boards is different from the Bingo number and randomly selected playing card indicia in the plurality of places of another game board;

(b) randomly selecting winning Bingo numbers which correspond to Bingo numbers on the game boards;

(c) marking the places on each of the game boards having the Bingo numbers corresponding to the winning Bingo numbers until some of the marked places on at least one of the game boards have a predetermined winning Bingo configuration;

(d) determining a winner of a Bingo portion of the game using the predetermined winning Bingo configuration;

(e) forming a Poker hand from the playing card indicia of the marked places forming the predetermined winning Bingo configuration to determine a winner of a Poker portion of the game.

12. The method of claim 11 wherein the winning Bingo numbers are randomly selected by a caller.

* * * * *